United States Patent [19]

Wiersema et al.

[11] 3,974,076

[45] Aug. 10, 1976

[54] FABRIC SOFTENER

[75] Inventors: Ype Wiersema; Ross Dale Rieke, both of Cincinnati, Ohio

[73] Assignee: The Procter & Gamble Company, Cincinnati, Ohio

[22] Filed: Jan. 11, 1974

[21] Appl. No.: 432,784

[52] U.S. Cl. ..... 252/8.8; 252/8.6; 252/8.75; 252/8.9; 252/547; 428/279; 428/289

[51] Int. Cl.[2] ..... D06M 13/46

[58] Field of Search ..... 117/139.5 F, 139.5 CQ; 252/8.6, 8.8, 8.9, 547

[56] References Cited

UNITED STATES PATENTS

| | | | |
|---|---|---|---|
| 3,537,993 | 11/1970 | Coward et al. | 252/8.8 |
| 3,686,025 | 8/1972 | Morton | 252/8.8 |
| 3,793,196 | 2/1974 | Okazaki et al. | 117/139.5 F |
| 3,850,818 | 11/1974 | Katsumi et al. | 252/8.8 |

*Primary Examiner*—Murray Tillman
*Assistant Examiner*—W. C. Danison, Jr.
*Attorney, Agent, or Firm*—Charles R. Wilson; Jerry J. Yetter; Richard C. Witte

[57] ABSTRACT

Liquid fabric softening compositions comprising a water-insoluble quaternary ammonium softener compound, an ethoxylated nonionic surfactant, an alkyl alcohol and other optional components, said compositions being characterized by the small particle size of the softener component which results in more efficient distribution and improved softening activity.

7 Claims, No Drawings

FABRIC SOFTENER

BACKGROUND OF THE INVENTION

The present invention encompasses fabric softener compositions adapted for use in the rinse cycle of a laundering operation. More specifically, the softener compositions herein comprise very small particles of a substantially water-insoluble, cationic fabric softening agent distributed in a liquid carrier. The small size of the particles, which accounts for their improved softening activity, is achieved by means of certain additives as described hereinafter.

Liquid fabric softening compositions have long been known in the art and are widely utilized by housewives during the wash and rinse cycles of automatic laundry operations. The term "fabric softening" as used herein and as known in the art refers to a process whereby a desirably soft handle and fluffy appearance are imparted to fabrics.

Compositions containing quaternary ammonium salts having at least one long chain hydrocarbyl group are commonly used to provide fabric softening benefits when used in laundry rinse operations. (See, for example, U.S. Pat. Nos. 3,364,142; 3,349,033; 3,546,115; 3,644,203; 3,733,463; also "Fabric Softeners and Their Evaluation", Manufacturing Chemist & Aerosol News, September, 1970, pages 39–45.) Although the various prior art softening compositions employing quaternary ammonium salts are effective for their intended purpose, there have been continuing efforts to provide more economical and effective fabric softening compositions.

Most liquid fabric softener compositions currently in use contain from about 3% to about 6% by weight of the softening agent dispersed in a carrier liquid. It might be assumed that to increase the effectiveness of such compositions it would merely be necessary to increase the level of softening agent. However, the use of high levels of softening agents is not economically attractive. More importantly, the use of excessively high concentrations of long-chain quaternary softeners in such compositions can result in an undesirable, greasy feel and a waterproofing effect on fabrics treated therewith. Accordingly, simply increasing the level of softening agent in such compositions is not an optimal means for increasing their effectiveness.

It has now been found that many prior art softening compositions, employed in the usual way by addition during the deep rinse cycle in an automatic washing machine, are not uniformly distributed over the fabric surfaces. Thus, certain areas of the fabric may receive relatively high levels of fabric softening agent, whereas other areas may receive little or none. This problem becomes particularly acute when the fabrics are folded or tangled, such that all surfaces are not exposed to the rinse liquor at the time the softener is added. Moreover, many housewives are wont to pour the fabric softener through the fabrics, where it is quickly absorbed, and do not make any particular effort to insure uniform distribution throughout the rinse bath.

It has now been found that by providing the fabric softening agent in a finely divided state, more uniform distribution throughout the rinse bath and on the fabrics can be secured. Accordingly, a substantial increase in softening effectiveness and uniformity can be secured without the need for increasing the concentration of softening agent in the composition. It has been found that dispersions of fabric softeners in the desired finely divided state can be provided by means of certain surfactants used in combination with long chain alcohols.

Moreover, it has now been found that the common cationic fabric softeners can lose much of their effectiveness in a rinse bath by virtue of the carryover of anionic surfactants from the wash cycle. When anionic surfactants are used to wash fabrics, they can be retained in substantial quantities on the fabric surfaces even after the spray rinse. Thus, when the softener is added to the final deep rinse, anionic surfactants may be present up to concentrations of 10 ppm, and greater, depending on machine design, surfactant usage, etc. These anionic surfactants undesirably interact with cationic fabric softeners, thereby detracting from their effectiveness. This problem is particularly acute inasmuch as a small proportion of anionic surfactant can flocculate a particle comprising many molecules of quaternary compound. Of course, the problem of interference by anionic surfactants can be overcome by very thoroughly rinsing the fabrics, or by completely avoiding anionic surfactants. However, since the average user is not disposed to take such extreme measures, it has been found to be advantageous to provide a material which will scavenge the undesirable anionic surfactants from the rinse bath, thereby preventing their interaction with the fabric softener. As will be seen hereinafter, certain water-soluble ethoxylated quaternary ammonium compounds are admirably suited for this purpose.

It is an object of the present invention to provide improved fabric softening compositions without recourse to excessive levels of softening agents.

It is another object of the present invention to provide compositions which achieve improved distribution of softener active throughout the aqueous rinse bath in an automatic washing machine.

Another object herein is to provide fabric softener compositions containing various additives which enhance the softening activity of the cationic fabric softeners.

These and other objects are obtained herein as will be seen by the following disclosure.

SUMMARY OF THE INVENTION

In its broadest aspect, the present invention encompasses liquid fabric softener compositions comprising a dispersion of a substantially water-insoluble quaternary ammonium softening compound, a surfactant, and an aliphatic alcohol in a liquid carrier. The compositions are characterized by the advantageously small particle size of the dispersed ingredients, which provides improved fabric softening.

More specifically, the compositions herein comprise:

a. a conditioning amount (preferably from about 3% to about 8% by weight) of a dispersed, particulate fabric softener component comprising i. from about 2 parts to about 10 parts (preferably from about 3 to about 8 parts) by weight of a quaternary ammonium compound of the formula -continued

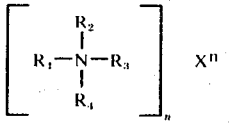

wherein $R_1$ and $R_2$ are each hydrocarbyl groups containing from about 1 to about 25 (preferably from about 12 to about 22) carbon atoms, the sum of $R_1+R_2$ being at least about 22 carbon atoms, $R_3$ and $R_4$ are each hydrocarbyl groups containing from 1 to about 6 (preferably from about 1 to about 3) carbon atoms, X is an anion and *n* is an integer from 1 to about 3 (preferably 1); and ii. from about 0.1 parts to about 2 parts by weight of an alkyl alcohol wherein the alkyl group contains from about 8 to about 20 (preferably 14 to 18) carbon atoms, the weight ratio of quaternary compound:alcohol being in the range of from about 100:1 to about 5:1;

b. from about 0.1% to about 2.0% by weight of a nonionic surfactant consisting of a lipophilic, hydrocarbyl moiety containing an equivalent of 6 to 20 (preferably 9 to 15) carbon atoms condensed with from 5 to about 15 (preferably 7 to 13) ethylene oxide hydrophilic moieties; and c. the balance comprising a water-soluble liquid carrier.

DETAILED DESCRIPTION OF THE INVENTION

The present compositions are characterized by the very small particle size of the fabric softener component therein. Although the diameters of dispersed particles are difficult to quantify in absolute terms, certain measurement techniques employing filters of known pore size make it possible to determine the approximate distribution of particle diameters. By using this filtration technique, which is more fully described hereinafter, it is possible to show that about 90% by weight of the quaternary ammonium compounds in the present compositions exist as particles which will pass through a 1.2 micron filter. In contrast, many commercial softeners now in use contain softener particles where only about 75% of the particles pass through a 1.2 micron filter, or larger.

The compositions herein are designed for use in the rinse bath of a standard laundry operation. The softening process comprises contacting fabrics in an aqueous rinse bath with sufficient composition to provide a concentration of fabric softening component of from about 10 ppm to 200 ppm, preferably about 30 ppm to 150 ppm, in the bath. The "conditioning amount" employed will depend on the desires of the user, the weight of fabric being softened in a given load, etc. Common usage levels of the softener active range from about 0.75 gm/5.0 lbs. fabric to 3.0 gms/5.0 lbs. fabric.

The compositions of the present invention are comprised of a variety of components which are described, in turn, below.

A. Quaternary Ammonium Compound

The quaternary ammonium compounds employed herein are the substantially water-insoluble materials well known in the art. The quaternary ammonium compounds herein can be prepared from alkyl halides in the manner described in U.S. Pat. No. 2,775,617.

More particularly, the quaternary compounds employed in the present compositions are substantially water-insoluble salts. By "substantially water-insoluble" is meant that these compounds are not substantially dissolved in water at a temperature below about 150°F. The water-insolubility of the quaternary compounds herein is the result of the hydrophobic characteristics of the hydrocarbyl substituents in the compounds. For purposes of the present invention, the requisite water-insolubility is realized when the total carbon content of groups $R_1$ and $R_2$ in the above formula is at least 22 carbon atoms. For most purposes, di-long chain compounds wherein groups $R_1$ and $R_2$ are each $C_{12}$–$C_{22}$ alkyl hydrocarbyl groups, and mixtures thereof, are preferred for use herein. However, compounds wherein group $R_1$ is a $C_{22}$ hydrocarbyl group, and greater, and wherein group $R_2$ is a short-chain hydrocarbyl group, are sufficiently water-insoluble to be useful herein. Groups $R_3$ and $R_4$ are as defined above.

Preferred quaternary compounds herein have groups $R_1$, $R_2$, $R_3$, $R_4$ as hydrocarbyl groups. The term "hydrocarbyl group" as employed herein encompasses alkyl, alkenyl, aryl, alkaryl, substituted alkyl and alkenyl, and substituted aryl and alkaryl groups. Common substituents found on quaternary compounds include hydroxy and alkoxy groups, and substituted compounds of this type are well recognized in the art as useful fabric softening materials and can be employed herein, providing the water-insolubility requirement is satisfied.

The most preferred quaternary compounds herein are those wherein the substituent groups $R_1$, $R_2$, $R_3$, and $R_4$ are alkyl groups. Especially preferred materials herein are the di-long chain compounds wherein $R_1$ and $R_2$ are each selected from the group consisting of $C_{12}$–$C_{22}$ alkyl groups, and mixtures thereof, and wherein $R_3$ and $R_4$ are each selected from the group consisting of short chain, i.e., $C_1$–$C_3$, alkyl moieties, and mixtures thereof.

While it is possible to prepare the quaternary compounds employed herein using pure alkyl amines or pure alkyl halides, for economic reasons raw materials with mixed hydrocarbyl groups are commonly employed. The use of such mixtures results in the formation of mixtures of the quaternary compounds, and all such mixtures are contemplated for use herein. A particularly advantageous quaternary mixture herein is a derivative of tallow chain length hydrocarbons, e.g., di-tallowalkyl dimethyl ammonium chloride.

In the quaternary compounds herein, the anion, X, provides electrical neutrality. The integer, n, is the valence of X. The nature of anion, X, is of no consequence to the present invention and any anion is useful herein. Most often, the anion used to provide electrical neutrality in quaternary compounds is a halide, such as fluoride, chloride, bromide, or iodide. However, particularly useful anions in fabric-softening quaternary compounds include methylsulfate, ethylsulfate, hydroxide, acetate, sulfate, carbonate, and the like. Chloride is especially preferred herein as anion, X, inasmuch as the alkyl chlorides are economically attractive precursors for preparing quaternary compounds.

The following are non-limiting examples of the water-insoluble, water dispersible quaternary compounds which can be employed herein: di-docosyl di-ethyl ammonium chloride; docosyl tripentyl ammonium bromide; docosyl tributyl ammonium methylsulfate; di-octadecyl dimethyl ammonium hydroxide; di-4-hexadecenyl dimethyl ammonium methylsulfate; tallowalkyl pentyl dimethyl ammonium chloride; di-tallowalkyl dimethyl ammonium chloride; di-tallowalkyl dimethyl ammonium methylsulfate; di-hexadecyl dimethyl ammonium chloride; di-octadecyl dimethyl ammonium chloride; di-eicosyl dimethyl ammonium chloride; di-docosyl dimethyl ammonium chloride; di-hexadecyl diethyl ammonium chloride; di-hexadecyl dimethyl ammonium acetate; di-tallowalkyl dipropyl ammonium phosphate; di-tallowalkyl dimethyl ammonium nitrate; and di(coconutalkyl) dimethyl ammonium chloride.

B. Nonionic Surfactant

The nonionic surfactant employed in the present compositions can be any of the ethoxylated materials of the particular type described hereinafter. In general terms, the nonionics herein are substantially water-soluble surfactants of the general formula $$R-O-(C_2H_4O)_z-C_2H_4OH$$

wherein R is selected from the group consisting of primary, secondary and branched chain alkyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from 6 to about 20, preferably 9 to 15, carbon atoms. In the general formula for the ethoxylated nonionic surfactants herein, z is in the range of from 4 to about 16, preferably 6 to 13.

The nonionic surfactants herein are characterized by an HLB (hydrophilic-lipophilic balance) of from about 8 to about 15, preferably from about 10 to about 14. Of course, by defining R and the number of ethoxylate groups, the HLB of the surfactant is, in general, determined. However, it is to be noted that the nonionic ethoxylated surfactants useful herein contain relatively long chain R groups and are highly ethoxylated. While short alkyl chain surfactants having short ethoxylated groups may possess the requisite HLB, they are not used herein.

Specific examples of nonionic surfactants useful herein are as follows. The examples are only by way of exemplification and are not intended to be limiting of such materials. In the examples, the integer defines the number of ethoxyl (EO) groups in the molecule.

Straight-chain, primary alcohol alkoxylates

The hexa-, hepta-, octa-, nona-, deca-, undeca-, dodeca-, tetradeca- and pentadeca-ethoxylates of n-octanol, n-decanol, n-dodecanol, n-tetradecanol, n-hexadecanol and n-octadecanol having an HLB within the range recited herein are useful surfactants in the context of this invention. Exemplary ethoxylated primary alcohols useful herein as the surfactant component of the compositions are n-$C_{10}$EO(6); n-$C_{10}$EO(9); n-$C_{12}$EO(9); n-$C_{14}$EO(10); n-$C_{10}$EO(10); n-$C_9$EO(9); n-$C_{16}$EO(14); and n-$C_{10}$EO(6). The ethoxylates of mixed natural or synthetic alcohols in the "coconut" chain length range are also useful herein. Specific examples of such materials include coconutalkyl-EO(6) and coconutalkyl-EO(9).

Straight-chain, secondary alcohol alkoxylates

The hexa-, hepta-, octa-, nona-, deca-, undeca-, dodeca-, tetradeca- and pentadeca-ethoxylates of 2-decanol, 2-tetradecanol, 3-hexadecanol, 2-octadecanol, 4-eicosanol, and 5-eicosanol having an HLB within the range recited herein are useful surfactants in the context of this invention. Exemplary ethoxylated secondary alcohols useful herein as the surfactant component of the compositions are: 2-$C_{12}$EO(9); 2-$C_{14}$EO(10); 2-$C_{16}$EO(11); 4-$C_{20}$EO(11); 2-$C_{16}$EO(14). The most preferred secondary alcohol ethoxylate herein is the material marketed under the tradename Tergitol 15-S-7, which comprises a mixture of secondary alcohols having an average hydrocarbyl chain length of 13 carbon atoms condensed with an average 7 moles of ethylene oxide per mole equivalent of alcohol.

Alkyl phenolic alkoxylates

As in the case of the alcohol alkoxylates, the hexa- through pentadeca-ethoxylates of alkylated phenols, particularly monohydric alkylphenols, having an HLB within the range recited herein are useful as the surfactant component of the instant compositions. The hexa- through pentadeca-ethoxylates of p-hexylphenol, m-octylphenol, p-octylphenol, p-nonylphenol and the like are useful herein; most preferred are the ethoxylates of p-octylphenol and p-nonylphenol, inasmuch as these materials are readily available. Exemplary ethoxylated alkyl phenols useful as the surfactant component of the mixtures herein are: p-octylphenol EO(9); p-nonylphenol EO(9); p-decylphenol EO(9). The most preferred alkylphenol ethoxylates herein are p-octylphenol (nonoxyethylene) and p-nonylphenol (nonoxyethylene).

As used herein and as generally recognized in the art, a phenol group in the surfactant formula is the equivalent of an alkyl group containing from 2 to 4 carbon atoms. For present purposes, nonionics containing a phenol group are considered to contain an equivalent number of carbon atoms calculated as the sum of the carbon atoms in the alkyl group plus about 3.3 carbon atoms for each phenol group.

Olefinic alkoxylates

The alkenyl alcohols, both primary and secondary, and alkenyl phenols corresponding to those disclosed immediately hereinabove can be ethoxylated to an HLB within the range recited herein and used as the surfactant component of the instant compositions. Typical alkenyl ethoxylates herein are 2-n-dodecenol EO(9); 3-n-tetradecenol EO(9); p-(2-noneyl) phenol EO(9); and 2-tetradecen-4-ol EO(9).

Branched chain alkoxylates

Branched chain primary and secondary alcohols which are available from the well-known "OXO" process can be ethoxylated and employed as the surfactant component of compositions herein. Exemplary branched-chain ethoxylates are as follows. 2-methyl-1-dodecanol EO(9); 3-ethyl-2-tetradecanol EO(9); 2-methyl-1-hexadecanol EO(8); and the like.

Particularly preferred among these ethoxylates of the primary OXO alcohols are the surfactants marketed under the name Dobanol by the Shell Chemicals, U.K., LTD. The preferred Dobanols are primary alcohols with hydrocarbyl groups of about 9 to about 11 carbon atoms, with the majority having a hydrocarbyl group of about 10 carbon atoms. Particularly preferred are Dobanols with an average degree of ethoxylation of about 6 to about 13.

The foregoing ethoxylated nonionic surfactants are useful in the present compositions and processes singly, or in combination, and the term "nonionic surfactant" encompasses mixed nonionic surface active agents.

The surfactant in the present compositions is employed at concentrations of at least about 0.1%, preferably 0.2% to about 2%, by weight. At concentrations below about 0.1% by weight the desired small particle size of the softener is not achieved, while concentrations above 2% by weight are not economically attractive since no further reduction in particle size is achieved.

C. Alkyl Alcohol

The alkyl alcohol compounds used in the present compositions are substantially straight chain alcohols having from about 8 to about 20 carbon atoms in the hydrocarbyl moiety.

Although lower alkyl alcohols, i.e., those having hydrocarbyl groups containing from about 2 to about 6 carbon atoms are useful herein, the higher chain length alcohols co-act with the surfactants and ammonium salts employed herein to provide the advantageously small particle size of the dispersed fabric softener. Moreover, the long-chain alcohols provide additional soft, lubricious tactile benefits to fabrics treated therewith.

Alkyl alcohols containing hydrocarbyl groups of from 14 to 18 carbon atoms are highly preferred for use herein on the basis of the additional softness benefits. Tallow alkyl alcohol is especially preferred from the standpoint of availability, effectiveness and economics.

Primary, secondary and tertiary alcohols having the requisite chain length are all useful herein. In order of preference, the primary alcohols are most preferred, followed by the secondary and then the tertiary alcohols. Non-limiting examples of alcohols useful in the present invention are: 1-hexadecanol; 1-heptadecanol; 1-octadecanol; 15-methyl-1-hexadecanol; 2-octadecanol; 2-hexadecanol; tallow alkyl alcohol; 1-tetradecanol; 2-pentadecanol; 1-methyl-1-hexadecanol; 1-decanol; and 1-octanol. Mixtures of the alcohols are, of course, equally efficacious and are commercially available.

D. Liquid Carrier

The liquid carrier employed in the instant compositions is preferably water, such preference being on the basis of economics. Other liquid carriers useful herein include any liquid which does not dissolve the softener active which is suitable for use in a laundry bath. In particular, mixtures of water and up to about 15% of a lower alcohol such as ethanol, propanol, isopropanol or butanol are useful as the carrier liquid.

E. Optional Components

The fabric softener compositions herein can contain additional optional components which provide various aesthetic and performance benefits. In particular, water-soluble ethoxylated quaternary ammonium compounds of the formula -continued

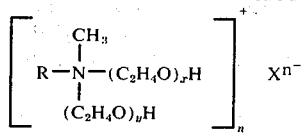

are especially useful additives herein. In the formula, group R is a substantially straight chain alkyl group of from about 14 to about 20 carbon atoms; $x$ and $y$ are integers of from 1 to about 5, the sum of $x+y$ being from 2 to about 6; X is an anion; and $n$ is an integer from 1 to about 3; preferably 1. Such water-soluble ammonium compounds can be used at concentrations of from 0.1% to about 3%, preferably from about 0.3% to about 2%, by weight of the present compositions and scavenge vagrant anionic surfactants carried over to the deep rinse from the wash cycle. Although not intending to be limited by theory, it is believed that the water-soluble ethoxylated quaternary ammonium compounds prevent the flocculation of the exceedingly small particles of softener by providing a complexing effect with the anionic surfactants in the water phase. In any event, the water-soluble, ethoxylated quats are especially useful in the present compositions to negate the anionic surfactant carry-over problem. Thus, the small particles of fabric softener component remain free to provide increased softening efficiency and penetration into and between the fabrics during the rinse cycle.

Moreover, it has been discovered that the incorporation of these water-soluble ethoxylated compounds enhances the desired particle size reduction as much as an additional 10 to 15% when used at the concentration levels described herein.

Particularly preferred water-soluble ethoxylated quaternary ammonium compounds for use as surfactant scavengers are those where, in the above formula, group R is $C_{16}$ to $C_{18}$ alkyl and mixtures thereof; $x$ and $y$ are each integers of from 1 to 3, the sum of $x+y$ being about 2 to about 4; n is the valence of X; and X is an anion as defined hereinabove, preferably bromide, chloride, sulfate, methyl sulfate and other like non-interfering anions. One such compound is marketed under the tradename Ethoquad 18/12 wherein R is $C_{18}$ alkyl; $x+y$ is about 2; $n$ is 1; and X is chloride.

Other additional components can be incorporated in the instant compositions to provide aesthetic and fabric conditioning benefits. Such additional components include perfumes, dyes, germicides, optical brighteners, anti-corrosion agents, such as sodium silicate, etc. Generally, these additional components comprise less than 1% by weight of the instant compositions.

The viscosity of the present compositions can optionally be reduced by the addition of an electrolyte such as $CaCl_2$ or NaCl. The amount of electrolyte used depends on the amount of active ingredients used in the compositions and can be adjusted according to the desires of the formulater. Optimally, the instant compositions have a viscosity of about 30 centipoise (cp) to about 300 cp, preferably 50 to 150 cp, at 25°C.

Other minor components include short chain alcohols such as isopropyl alcohol which are present in the commercially available quaternary ammonium compounds used to prepare the compositions herein.

Compositions Making and Characterization

The softener compositions of the present invention comprise very small particles comprising a mixture of the quaternary ammonium compound and the alcohol dispersed in a water-soluble carrier liquid. Since both the quat and the alcohol are each substantially water-insoluble, the softener particle is also substantially water-insoluble. The particulate softener comprises from about 2 to about 10 parts (preferably about 3 to about 8 parts) by weight of the quaternary ammonium compound and from about 0.1 parts to about 2 parts (preferably about 0.1 to about 1 part) by weight of the alcohol. The weight ratio of quat:alcohol in the softener particles is from about 100:1 to 3:1, most preferably 20:1 to 5:1.

The mixed quat/alcohol softener particles are dispersed in a carrier liquid in the presence of a surfactant. Water and water-alcohol mixtures, e.g., 5% ethanol/95% water, are the most convenient carriers. In the presence of water, the softener particles exist in association with water molecules, due to the hygroscopic character of the quaternary ammonium compound. The actual amount of water associated with the particles of softener is immaterial for the purposes of this invention, and is difficult to quantify. In general, from about 0.5 to about 10 parts by weight of water associate with the particles.

The nonionic surfactants used in the present composition aid in securing and maintaining the small size of the particle of softener and dispersing them uniformly in the liquid carrier. While not intending to be limited by theory, it appears that the surfactants somehow associate with the mixed quat/alcohol softener to provide the small highly dispersed softener particles. Neither the alcohol nor the surfactant, singly, provides the desirable small particle size. While the nature of the complex quat/alcohol/surfactant interaction is not fully understood, the fact remains that this combination provides unique fabric softening advantages.

The preferred method of making the instant compositions is designed to secure the softener as very small particles dispersed uniformly throughout the carrier. First, the water-insoluble quaternary ammonium compound, alkyl alcohol and nonionic surfactant are premixed at a temperature of about 100°F to about 160°F. Optional components such as dye, brightener and the like can be included in the pre-mix. The pre-mix is added, preferably by injection, to the liquid phase at a temperature of about 100°F to about 140°F over a period of time depending on the size of the batch to be made. For batch sizes of about 500 lbs., the period of addition is from about 1 to about 30 minutes. This injection technique is used in combination with shear agitation to insure uniform distribution of the softener particles throughout the carrier liquid.

The foregoing procedure provides softener compositions wherein the quat/alcohol softener is in the form of very small particles. As is known in the art, particle diameters of dispersed materials are not easily determinable in absolute terms. Moreover, the quat/alcohol particles herein pose especially difficult measurement problems since they exist as deformable globules whose diameters vary with pressure. However, using the technique discussed below, useful information as to particle size distributions can be obtained. Moreover, the substantial difference in particle size of the present softener dispersions over commercial fabric softeners becomes quite evident.

One useful measurement technique involves filtering diluted fabric softener compositions through commercially available filters having average pore sizes of about 1.2 microns, and below. Particles whose diameters are substantially larger than the pore size of the filters are removed from dilute solutions of the instant compositions. By titrating the quaternary ammonium compound which remains in the filtrate (or remaining in the filtered liquid) with standardized anionic surfactant solution and comparing this with the known amount of quaternary compound in the total composition, the amount of softener existing as particles which are too large to pass through any particular pore size can be determined.

Another technique comprises the same initial filtering procedure, but uses a carbon analyzer to determine the amount of total carbon in the filtrate (in the alternative, the amount of total carbon passing through the filter can be determined). In this manner, the amount of carbon-containing material that is filtered out at a certain filter pore size is determined. Knowing the total carbon content, back-calculations can be used to show the amount of particles retained by a filter of given pore size.

The following examples illustrate the compositions herein and their method of manufacture and use, but are not intended to be limiting thereof.

EXAMPLE I

A fabric softener composition in liquid form is as follows:

| Ingredient | Wt.% |
|---|---|
| DTDMAC (75% ditallow dimethyl ammonium chloride + 15% isopropanol + 10% water | 10% |
| Tallow alkyl alcohol | 1% |
| *Dobanol 91-8 | 1% |
| **Optical brightener solution (10% active) | 1.5% |
| Dye (polar brilliant blue:1.5% in water) | 0.1% |
| ***Bronopol (bacteriostat) | 0.005% |
| Water | Balance to 100% |

*The Dobanol 91-8 is an ethoxylate of primary "OXO" alcohols having an average alcohol molecular weight 160. The alcohols used to prepare this Dobanol 91-8 ethoxylate are primarily $C_9$—$C_{11}$, with the major proportion being $C_{10}$. The final integer indicates the degree of ethoxylation.

**The optical brightener solution is 6 parts water, 3 parts ethanol and 1 part 3-deca(oxyethylene)-2,5 diphenyl furan, by weight.

***A commercial brominated diol bacteriostat, marketed by Boots Pure Drug Company.

The pre-mix comprising 80 grams of the commercial DTDMAC, 8 grams of tallowalkyl alcohol, and 8 grams of Dobanol 91-8 are heated in a beaker to a temperature of 160°F. To this pre-mix are added 12 grams of the solution of optical brightener. The total pre-mix is stirred until homogeneous.

The above softener pre-mix is sprayed into a glass baffle beaker containing 689 grams of water, 0.8 grams of dye solution and 0.04 grams of bacteriostat at a temperature of 120°F. The softener pre-mix is sprayed into the heated water about 1 millimeter above the shearing blades of an electric stirrer in the baffle beaker. The spraying orifice is about 0.05 centimeters in diameter and spraying is completed in about 5 to 10 minutes. The viscosity of the above composition is lowered to about 100 cp by the addition of 0.05 grams of $CaCl_2$.

The above softener composition is found to have a particle size distribution such that 50% of the softener particles pass through a filter of 0.5 microns.

60 Grams of the composition are added to 9 gallons of rinse water containing 8 lbs. of freshly laundered clothes. The rinse water remains in contact with the clothes for ca. 3 minutes and is then drained. The clothes are line dried and are found to have a uniformly soft, anti-static finish.

EXAMPLE II

A fabric softener composition is prepared on a commercial scale as follows.

| Ingredient | |
|---|---|
| DTDMAC (75% ditallow dimethyl ammonium chloride + 15% isopropyl alcohol, 10% water) | 8.75% |
| Tallow alkyl alcohol | 0.5% |
| Tergitol 15-S-7 | 0.5% |
| Optical brightener solution (1 part brightener, 3 parts ethanol, 6 parts water) | 1.425% |
| Perfume | 0.01% |
| Dye (1.5% solution in water) | 0.09% |
| Water | Balance to 100% |

A pre-mix is prepared by combining 35 lbs. of DTDMAC, 5.7 lbs. optical brightener solution, 2 lbs. of tallowalkyl alcohol, and 2 lbs. of Tergitol 15-S-7 in a 10 gal. baffle mixing vat. The pre-mix is heated to 150°F and stirred to provide a uniformly distributed mixture.

45 Gallons of water are heated to a temperature of 120°F in a large mixing vat with rotary stirrer having 4 blades/10 inch by 2 inch. The dye is added to the heated water.

The pre-mix is fed into the heated water/dye solution through a nozzle having orifice of about 0.5 inch. The nozzle is adjusted to feed the pre-mix about 0.25 inch above the blades, which provide a shearing force at the water/pre-mix interface. The blades are operated at a speed of about 100 rpm. The time of pre-mix addition is about 10 minutes.

The softener composition is cooled to a temperature of 80°F and 0.04 lb. perfume is added.

The viscosity of the softener composition is adjusted to 100 centipose using 0.08 lbs. $CaCl_2$ predissolved in 100 cc of water.

The foregoing softener composition has a softener particle size range such that 50% of the softener exists as particles having a diameter below about 0.5 microns, as measured by filtration.

In the above composition, the ditallow dimethyl ammonium chloride is replaced by an equivalent amount of distearyl dimethyl ammonium methylsulfate; ditetradecyl dipentyl ammonium bromide; docosyl triethyl ammonium iodide; and dihexadecenyl diethyl ammonium chloride, respectively, and substantially similar results are obtained.

In the above softener composition, the Tergitol 15-S-7 is replaced by an equivalent amount of nonylphenoxylpoly(ethyleneoxy) ethanol marketed under the tradename Igepal Co-710 commercially available from the GAF Corporation, Chemical Division (a condensation product of nonylphenol and about 12.8 moles of ethylene oxide); and Neodol 23-6.5 (the condensation product of an average of 6.5 moles of ethylene oxide with mixed primary $C_{12}$–$C_{13}$ alcohols) commercially available from Shell Oil Company, respectively, and equivalent results are secured.

EXAMPLE III

A fabric softener containing an anionic surfactant scavenger is prepared as follows.

| Ingredients | Wt. % |
|---|---|
| Distearyl diethyl ammonium methylsulfate | 5.0% |
| Ethoquad 18/12 | 2.0% |
| *Igepal CO-710 | 0.65% |
| Cetyl Alcohol | 0.65% |
| Optical brightener solution (10% active) | 1.5% |
| Dye (Polar brilliant blue:1.5% in water) | 0.1% |
| Water | Balance to 100% |

*A commercially available nonionic surfactant from the GAF Company comprising a nonylphenoxypoly(ethyleneoxy)ethanol.

A pre-mix comprising 50 grams of distearyl diethyl ammonium methylsulfate, 6.5 grams of cetyl alcohol, 6.5 grams of Igepal CO-710 are heated in a beaker to a temperature of 160°F. To this pre-mix are added 15 grams of a solution of the optical brightener. The pre-mix is stirred until homogeneous.

This above softener pre-mix is sprayed into a glass baffle beaker containing 901 grams of water with 1 gram of dye solution and 20 grams of Ethoquad 18/12 uniformly mixed at a temperature of 120°F. The softener pre-mix is fed into the heated water about 1 millimeter above the shearing blades of an electric stirrer in the baffle beaker. The feed orifice is about 0.05 centimeters in diameter and spraying is completed in about 5 to 10 minutes.

The above softener composition is found to have a particle size distribution such that 65% of the softener particles pass through a 0.5 micron filter.

In the above composition the distearyl diethyl ammonium methylsulfate is replaced by an equivalent amount of dihexadecyl dipropyl ammonium chloride; ditallow diethyl ammonium carbonate; and di-eicosyl dimethyl ammonium floride, respectively, and equivalent results are achieved.

In the above composition, the Ethoquad 18/12 is replaced by an equivalent amount of Ethoquad HT/12, a commercially available product from the Armak Company, which has the same structure Ethoquad 18/12 except the long chain alkyl group is derived from tallowalkyl alcohol. Equivalent results are achieved.

In the above composition, the cetyl alcohol is replaced by an equivalent amount of stearyl alcohol and myristyl alcohol, respectively, and equivalent results are achieved.

As can be seen from the foregoing, the compositions herein are formulated as very small suspended particles of the softener active, i.e. 40–50% of the particles pass through a 0.5 micron filter; up to 90% pass through a 1.2 micron filter. This small particle size results in the superior performance benefits of the compositions herein without recourse to the use of excessive amounts of softener active.

What is claimed is:

1. A fabric softener composition, comprising:

a. a conditioning amount of dispersed water-insoluble softener component particles having a size such that about 40% to about 50% of the particles pass through a filter having an average pore diameter of about 0.5 microns, said particles comprising a mixture of i. from about 2 parts to about 10 parts by weight of a substantially water-insoluble quaternary ammonium compound of the formula

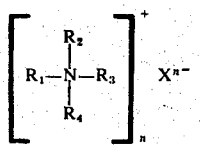

wherein $R_1$ and $R_2$ are each hydrocarbyl groups containing from about 1 to about 25 carbon atoms, the sum of $R_1$ and $R_2$ being at least 22 carbon atoms, $R_3$ and $R_4$ are each hydrocarbyl groups containing from about 1 to about 6 carbon atoms, X is an anion and $n$ is an integer from 1 to about 3;

ii. from about 0.1 part to about 2 parts by weight of a substantially water-insoluble straight chain alcohol containing from about 8 to about 20 carbon atoms, the weight ratio of said quaternary compound to said alcohol being in the range of from about 100:1 to about 3:1;

b. from about 0.1% to about 2.0% by weight of a nonionic surfactant containing a lipophilic hydrocarbyl group of from about 6 to about 20 equivalent carbon atoms and from about 5 to about 15 ethylene oxide moieties;

c. from about 0.1% to about 3% by weight of a water-soluble ethoxylated quaternary ammonium compound of the formula

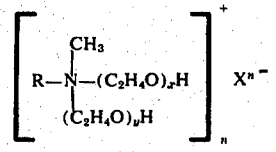

wherein R is a substantially straight chain alkyl group of from about 14 to about 20 carbon atoms; $x$ and $y$ are each integers of from 1 to 5, the sum of $x + y$ being from about 2 to about 6; X is an anion and $n$ is an integer from 1 to 3; and d. the balance comprising a water-soluble liquid carrier.

2. A composition according to claim 1 wherein the water-insoluble quaternary ammonium compound is a dimethyl dialkyl ammonium quaternary compound wherein the alkyl groups each contain about 12 to about 22 carbon atoms.

3. A composition according to claim 1 wherein the alcohol is selected from the group consisting of decyl alcohol, dodecyl alcohol, tetradecyl alcohol, hexadecyl alcohol, octadecyl alcohol, and tallowalkyl alcohol.

4. A composition according to claim 1 wherein the nonionic surfactant has the formula $R—O—(C_2H_4O)_z—C_2H_4OH$ wherein R is a hydrocarbyl group having 9 to 15 carbon atoms and $z$ ranges from 6 to 13.

5. A composition according to claim 1 wherein up to 90% of the softener component particles pass through a filter having an average pore diameter of 1.2 microns.

6. A composition according to claim 1 wherein the softener component comprises from about 3% to about 8% by weight of the composition.

7. A composition according to claim 6 wherein the softener component comprises ditallow dimethyl ammonium chloride and tallowalkyl alcohol.

* * * * *